US009413093B2

(12) United States Patent
Hashiguchi

(10) Patent No.: US 9,413,093 B2
(45) Date of Patent: Aug. 9, 2016

(54) CONNECTOR ASSEMBLY

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/681,645

(22) Filed: Apr. 8, 2015

(65) Prior Publication Data

US 2015/0340787 A1 Nov. 26, 2015

(30) Foreign Application Priority Data

May 23, 2014 (JP) ..... 2014-107023

(51) Int. Cl.

| | |
|---|---|
| ***H01R 13/05*** | (2006.01) |
| ***H01R 24/66*** | (2011.01) |
| ***H01R 12/73*** | (2011.01) |
| ***H01R 13/11*** | (2006.01) |

(52) U.S. Cl.

CPC ..... *H01R 13/05* (2013.01); *H01R 12/73* (2013.01); *H01R 13/113* (2013.01); *H01R 24/66* (2013.01)

(58) Field of Classification Search

USPC ..... 439/246, 862, 291, 74, 83, 290, 76.1, 439/264, 656; 174/53, 59; 257/700, 692

See application file for complete search history.

(56) References Cited

U.S. PATENT DOCUMENTS 4,738,631 A * 4/1988 Takahashi et al. ..... 439/248
6,155,856 A * 12/2000 Sanada ..... 439/246

(Continued)

FOREIGN PATENT DOCUMENTS

JP 2000164276 A 6/2000
JP 2001160442 A 6/2001

(Continued)

*Primary Examiner* — Alexander Gilman

(74) *Attorney, Agent, or Firm* — Holtz, Holtz & Volek PC

(57) ABSTRACT

A connector assembly comprises a first connector and a second connector. The second connector is connectable with the first connector. The first connector comprises a plurality of first contacts. The second connector comprises a plurality of second contacts. Each of ones of the first contacts and the second contacts has a pressed portion. Each of remaining ones of the first contacts and the second contacts has a contact portion and a spring portion. One of the first connector and the second connector comprises the remaining ones of the first contacts and the second contacts. The one of the first connector and the second connector comprises receiving portions. The contact portions correspond to the receiving portions, respectively. Under a state where the first connector and the second connector are connected with each other, the contact portion allows a movement of the pressed portion in a plane parallel to a first principal surface while pressing the pressed portion against the receiving portion in a perpendicular direction perpendicular to the first principal surface due to a resilient force of the spring portion.

13 Claims, 10 Drawing Sheets

(56) References Cited

U.S. PATENT DOCUMENTS

| | | | | |
|---|---|---|---|---|
| 6,193,537 | B1 * | 2/2001 | Harper et al. | 439/291 |
| 6,379,170 | B1 * | 4/2002 | Czeschka et al. | 439/291 |
| 6,464,512 | B2 * | 10/2002 | Morita | 439/66 |
| 6,586,830 | B2 * | 7/2003 | Saito | 257/700 |
| 6,881,075 | B2 * | 4/2005 | Huang et al. | 439/74 |
| 7,110,246 | B2 * | 9/2006 | Tsunooka et al. | 361/637 |
| 7,179,095 | B1 * | 2/2007 | Peng et al. | 439/74 |
| 7,322,834 | B2 * | 1/2008 | Hu et al. | 439/83 |
| 8,858,239 | B2 * | 10/2014 | Little et al. | 439/74 |
| 8,961,209 | B2 * | 2/2015 | Kobayashi et al. | 439/264 |

FOREIGN PATENT DOCUMENTS

| | | | |
|---|---|---|---|
| JP | 2001332644 | A | 11/2001 |
| JP | 2003197297 | A | 7/2003 |
| JP | 2006019110 | A | 1/2006 |
| JP | 2013033598 | A | 2/2013 |

* cited by examiner

CONNECTOR ASSEMBLY

CROSS REFERENCE TO RELATED APPLICATIONS

An applicant claims priority under 35 U.S.C. §119 of Japanese Patent Application No. JP2014-107023 filed May 23, 2014.

BACKGROUND OF THE INVENTION

This invention relates to a connector assembly comprising two connectors.

In a case where a semiconductor package 900 and a circuit board 910 are connected with each other, stresses might be caused by a difference in thermal expansion coefficient therebetween. JP-A 2001-332644 (Patent Document 1) discloses a structure which solves a problem that the stresses are applied to connection portions therebetween. Specifically, as shown in FIG. 18, Patent Document 1 discloses that the semiconductor package 900 and the circuit board 910 are connected by using an interposer 920. The interposer 920 of Patent Document 1 is provided with inner terminals 930 and outer terminals 940. Since the outer terminals 940 are formed so as to be deformable, the stresses are absorbed by deformations of the outer terminals 940.

However, the structure of Patent Document 1 has a drawback that the outer terminals 940 might continue to receive stresses after being deformed as described above. In addition, the structure of Patent Document 1 has another drawback that it is difficult to reduce a distance between the semiconductor package 900 and the circuit board 910.

SUMMARY OF THE INVENTION

It is therefore an object of the present invention to provide connecting means which can effectively relieve stresses caused by a difference in thermal expansion coefficient between two objects after the two objects are connected with each other.

One aspect of the present invention provides a connector assembly comprising a first connector and a second connector. The first connector is to be fixed on a first principal surface of a first connection object. The second connector is to be fixed on a second principal surface of a second connection object. The second connector is connectable with the first connector. The first connection object and the second connection object are different in thermal expansion coefficient from each other. The first connector comprises a plurality of first contacts. The first contacts are to be separated from each other and soldered on the first principal surface. The second connector comprises a plurality of second contacts. The first contacts correspond to the second contacts, respectively. The second contacts are to be soldered on the second principal surface. Each of ones of the first contacts and the second contacts has a pressed portion. Each of remaining ones of the first contacts and the second contacts has a contact portion and a spring portion. The spring portion resiliently supports the contact portion. One of the first connector and the second connector comprises the remaining ones of the first contacts and the second contacts. The one of the first connector and the second connector comprises receiving portions. The contact portions correspond to the receiving portions, respectively. Under a state where the first connector and the second connector are connected with each other, the contact portion allows a movement of the pressed portion in a plane parallel to the first principal surface while pressing the pressed portion against the receiving portion in a perpendicular direction perpendicular to the first principal surface due to a resilient force of the spring portion.

Another aspect of the present invention provides a connector connectable with a mating connector which is fixed on a second principal surface of a mating connection object. The connector is to be fixed on a first principal surface of a connection object. The connector comprises a plurality of contacts. The contacts are to be separated from each other and soldered on the first principal surface of the connection object. Before the connector is fixed on the first principal surface of the connection object, the connector further comprises a temporary coupling portion which couples the contacts with each other. After the contacts are soldered on the first principal surface of the connection object, the temporary coupling portion is, at least in part, separated from the connector so that the contacts are separated from each other.

The first contacts of the present invention are separated from each other and soldered on the first principal surface. Accordingly, the first contacts are relatively movable with respect to each other so that the first contacts can respond to expansion and contraction of the first connection object.

In addition, the contact portion of the present invention allows a movement of the pressed portion in a plane parallel to the first principal surface while pressing the pressed portion against the receiving portion in a perpendicular direction perpendicular to the first principal surface due to a resilient force of the spring portion. Accordingly, the movement of the pressed portion relieves stress which is caused by thermal expansion or thermal contraction of the first connection object. Thus, connection portions between the first contacts and the second contacts of the present invention do not have the aforementioned drawbacks of the structure of Patent Document 1.

An appreciation of the objectives of the present invention and a more complete understanding of its structure may be had by studying the following description of the preferred embodiment and by referring to the accompanying drawings.

Figure 1:
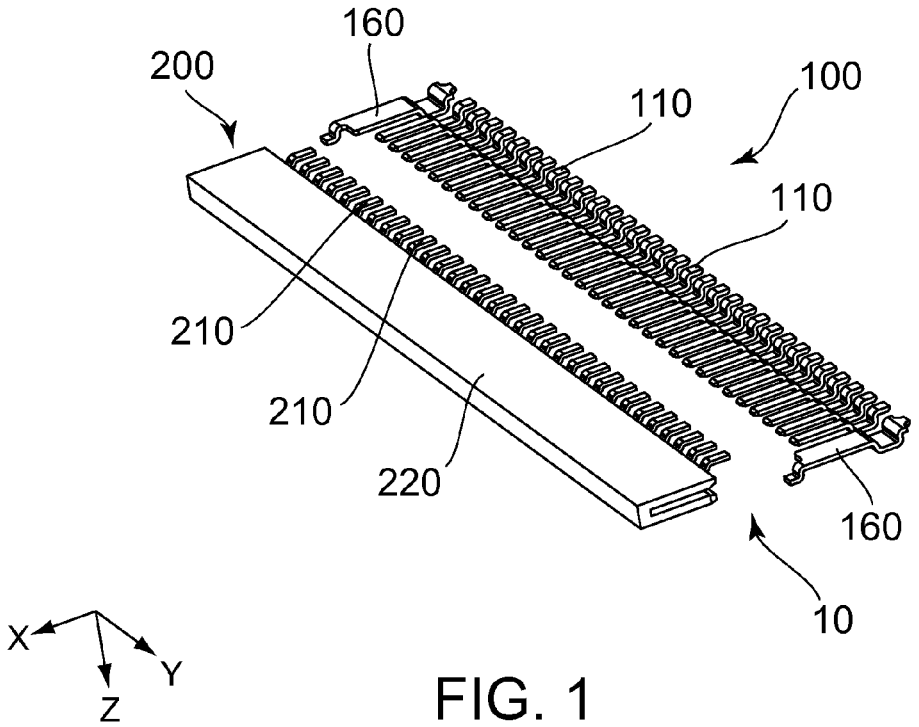
FIG. 1 is a perspective view showing a connector assembly comprising a first connector and a second connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
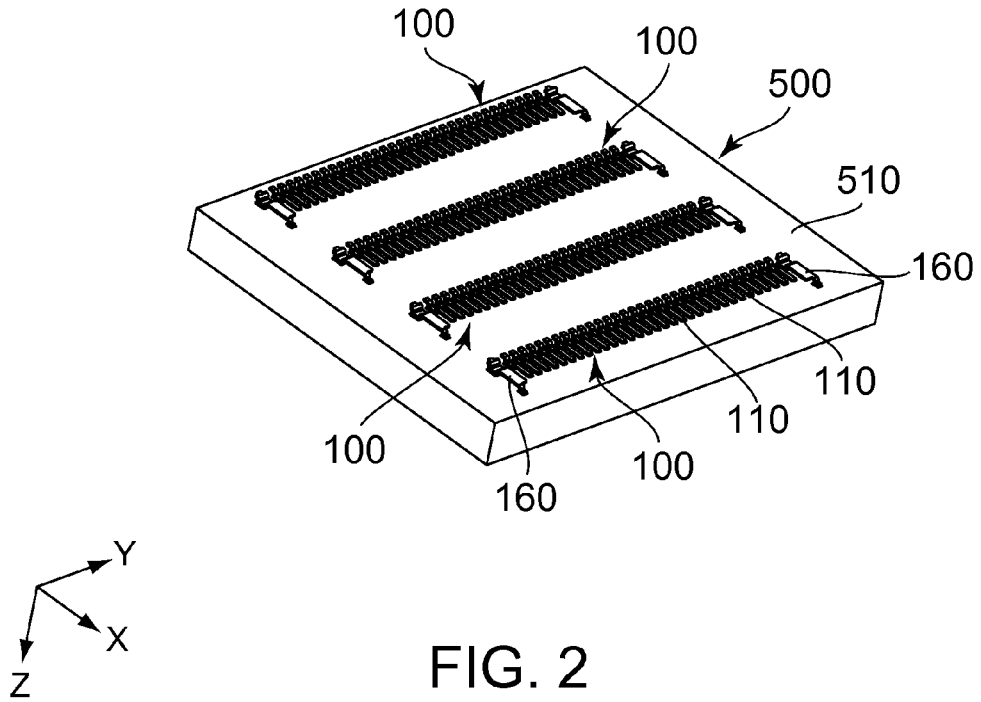
FIG. 2 is a perspective view showing the first connector of FIG. 1. The first connector is fixed on a first connection object.
Figure 3:
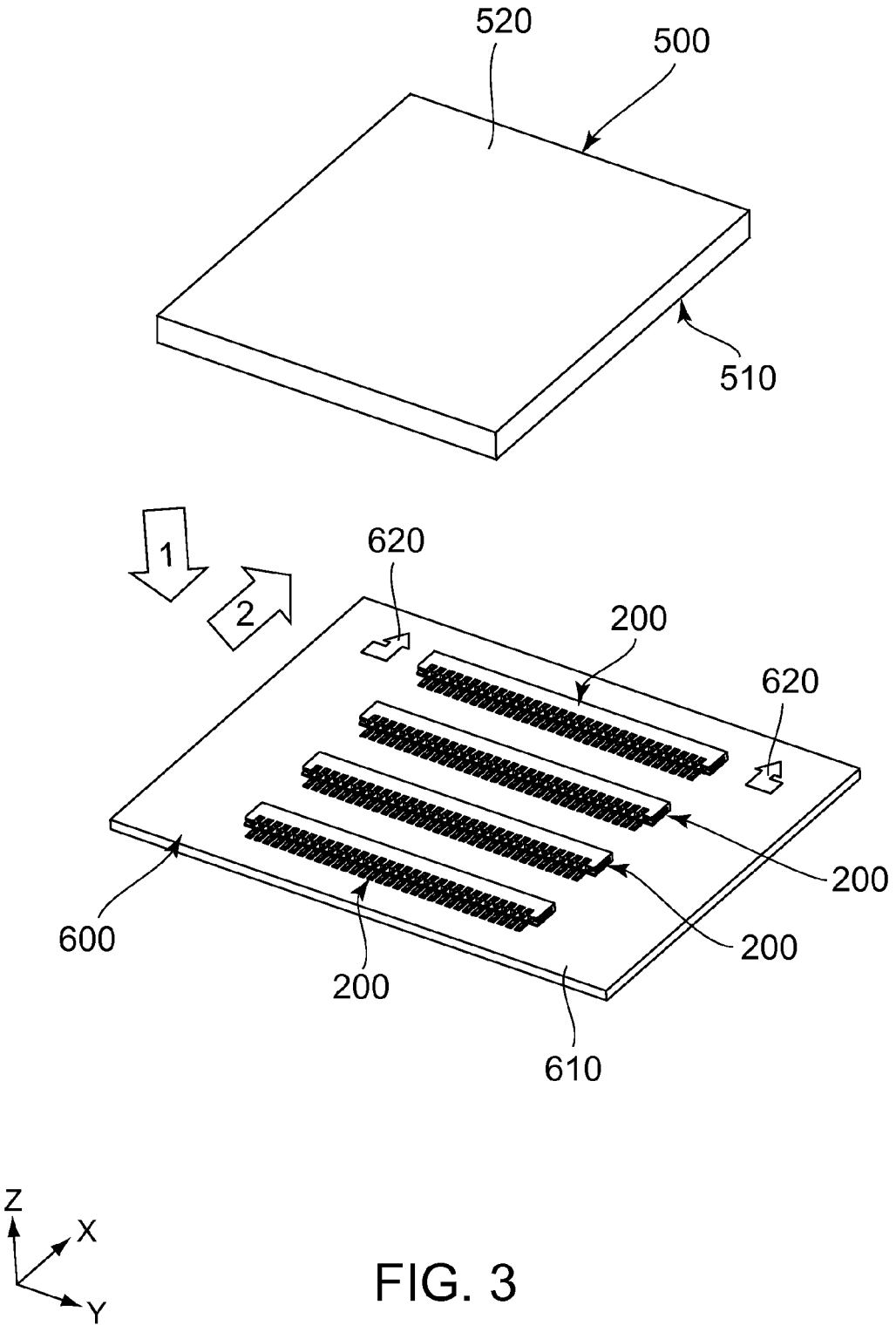
FIG. 3 is a perspective view for use in explaining how to connect the first connector fixed on the first connection object with the second connector fixed on a second connection object. The first connector is hidden by the first connection object so that the first connector cannot be seen in FIG. 3.

DESCRIPTION OF PREFERRED EMBODIMENTS:

With reference to FIGS. 1 and 4 to 6, a connector assembly 10 according to an embodiment of the present embodiment comprises a first connector (connector) 100 and a second connector 200 (mating connector). The second connector 200 is connectable with the first connector 100. As shown in FIG. 2, four of the first connectors 100 are fixed on a first principal surface 510 which is one of principal surfaces of a first connection object (connection object) 500. As shown in FIG. 3, four of the second connectors 200 are fixed on a second principal surface 610 which is one of principal surfaces of a second connection object (mating connection object) 600.

In the present embodiment, the first connection object 500 is a semiconductor package, and the second connection object 600 is a circuit board. Specifically, the first connection object 500 and the second connection object 600 are different in thermal expansion coefficient from each other.

Figure 7:
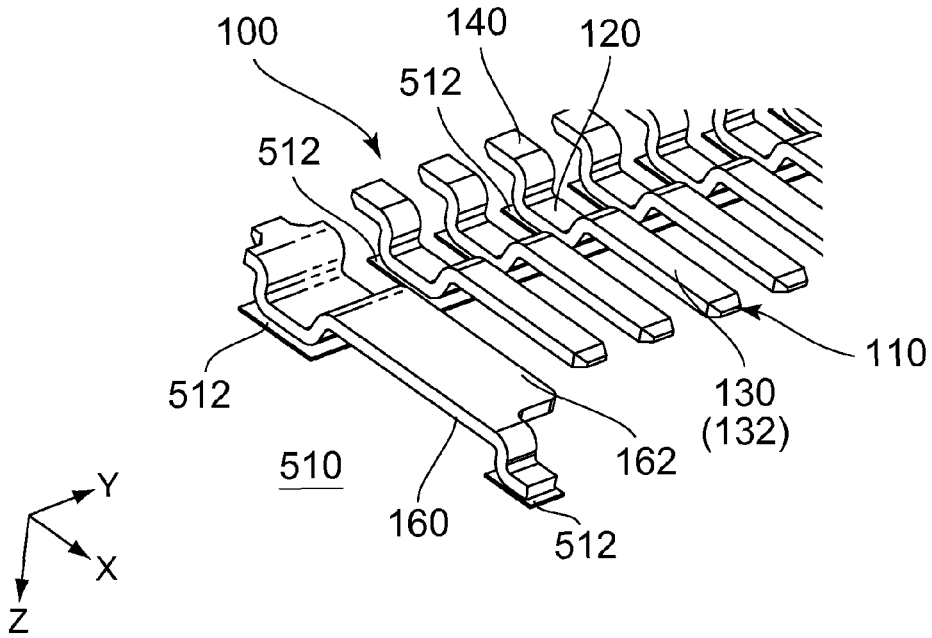
FIG. 7 is an enlarged, perspective view showing a part of the first connector of FIG. 2.

As shown in FIG. 1, each of the first connectors 100 comprises a plurality of first contacts 110 and two guide members 160. The first contacts 110 are arranged in a Y-direction (pitch direction). The two guide members 160 are positioned outward of the first contacts 110 in the Y-direction. Specifically, the first contacts 110 are positioned between the two guide members 160 in the Y-direction. As shown in FIGS. 2 and 7, the first contacts 110 are separated from each other and soldered on the first principal surface 510, and each of the guide members 160 is separated from the first contacts 110 and soldered on the first principal surface 510. Specifically, a movement of each of the first contacts 110 and the guide members 160 is restricted only by a portion thereof that is soldered on the first principal surface 510 of the first connection object 500. Accordingly, in the present embodiment, intervals between the first contacts 110 can be varied in accordance with thermal expansion and contraction of the first connection object 500, and intervals between the first contacts 110 and the guide members 160 can be varied in accordance therewith. Solderings of the first contacts 110 and the guide members 160 on the first principal surface 510 are described later.

Figure 14:
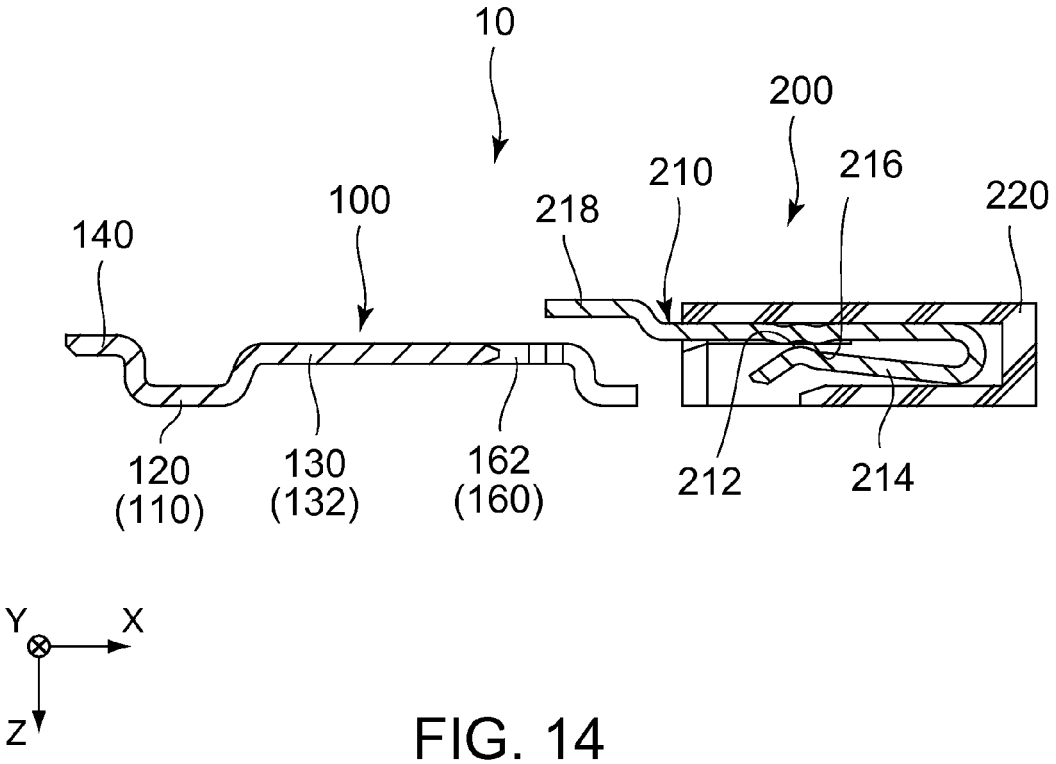
FIG. 14 is a cross-sectional view showing the connector assembly of FIG. 6, taken along line A-A. The first connector is not connected with the second connector yet.
Figure 15:
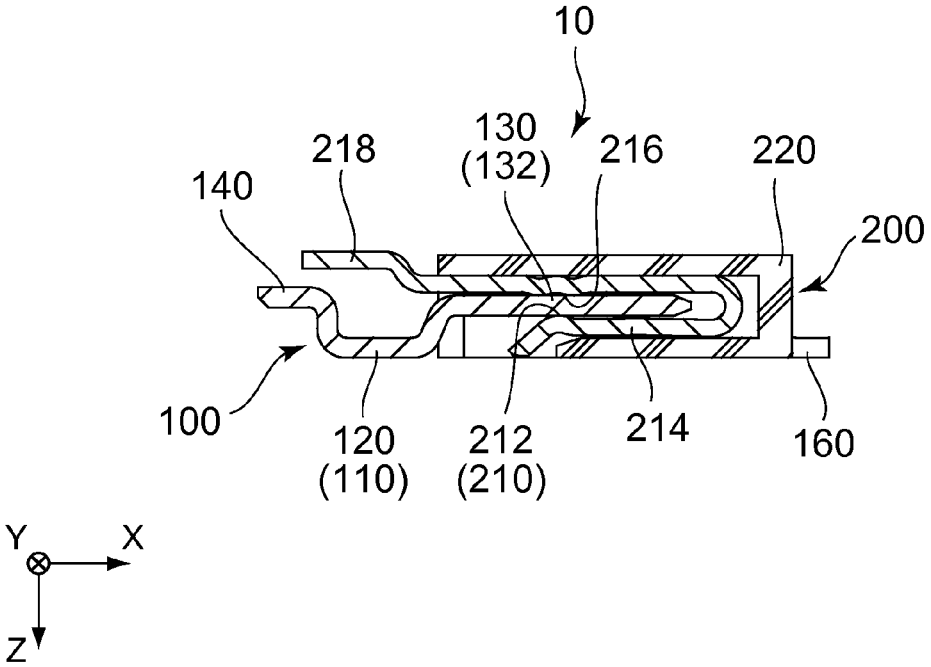
FIG. 15 is a cross-sectional view showing the connector assembly of FIG. 6, taken along line A-A. The first connector is connected with the second connector.

As shown in FIGS. 7, 14 and 15, each of the first contacts 110 has a soldered portion 120, a primary portion 130 and a secondary portion 140. As shown in FIG. 7, pads 512 are provided on the first principal surface 510, and the soldered portions 120 are soldered on the pads 512, respectively. As shown in FIGS. 7, 14 and 15, each of the primary portions 130 extends in one direction from the soldered portion 120, and each of the secondary portions 140 extends in another direction from the soldered portion 120. Each of the primary portions 130 of the present embodiment has an elongated, plate-like pressed portion 132. Each of the pressed portions 132 extends in an XY-plane which is defined by an X-direction (connection direction of the first connector 100 and the second connector 200) and the Y-direction. In other words, each of the pressed portions 132 extends in parallel with the first principal surface 510 (see FIG. 2).

As understood from FIGS. 2 and 8 to 11, in the present embodiment, a temporary coupling portion 300 couples the first contacts 110 and the guide members 160 with each other. The temporary coupling portion 300 is made of insulator. Thus, the first contacts 110 and the guide members 160 are together soldered on the first principal surface 510.

Figure 8:
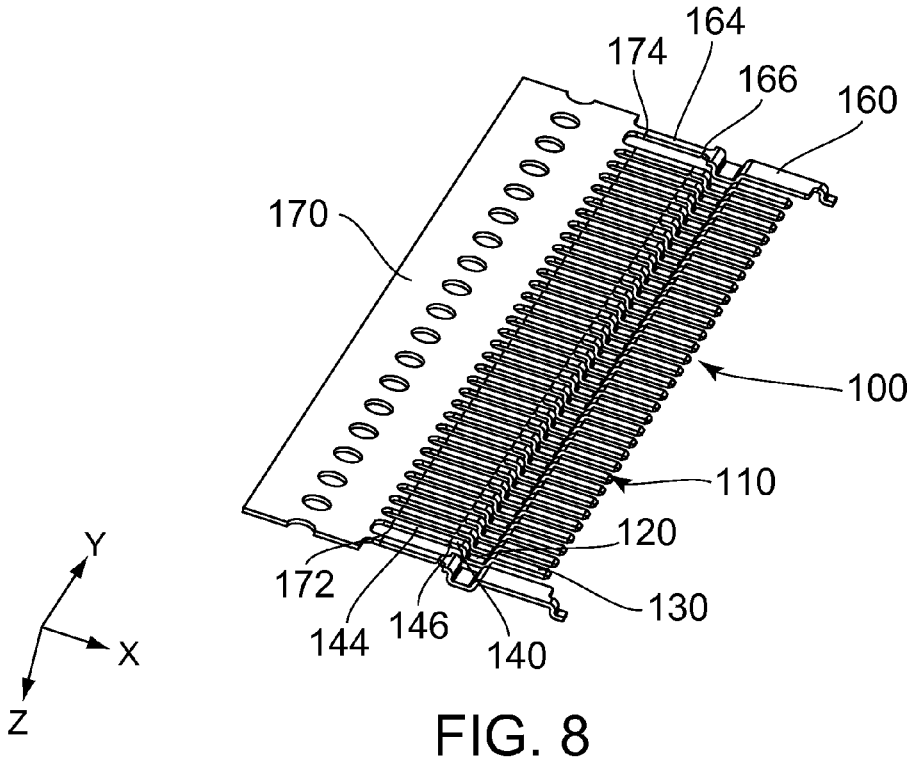
FIG. 8 is a perspective view showing the first connector of FIG. 1. The first connector is connected with a carrier through a plurality of extending portions.

In detail, as shown in FIG. 8, the first connector 100 further comprises a plurality of extending portions 144 and two extending portions 164 under a state where a single metal sheet is pressed to form the first connector 100. As understood from the above explanation, the first contacts 110, the guide members 160, the extending portions 144 and the extending portions 164 are provided on a common member. Before the first connector 100 is fixed on the first principal surface 510 (see FIG. 2), the extending portions 144 extend from the first contacts 110, respectively. Similarly, before the first connector 100 is fixed on the first principal surface 510, the extending portions 164 extend from the guide members 160, respectively. The extending portions 144 and the extending portions 164 are connected with a carrier 170. At each of boundary portions between the extending portions 144 and the first contacts 110, a notch 146 is formed. Furthermore, at each of boundary portions between the extending portions 144 and the carrier 170, a notch 172 is formed. Similarly, at each of boundary portions between the extending portions 164 and the guide members 160, a notch 166 is formed. Furthermore, at each of boundary portions between the extending portions 164 and the carrier 170, a notch 174 is formed.

Figure 9:
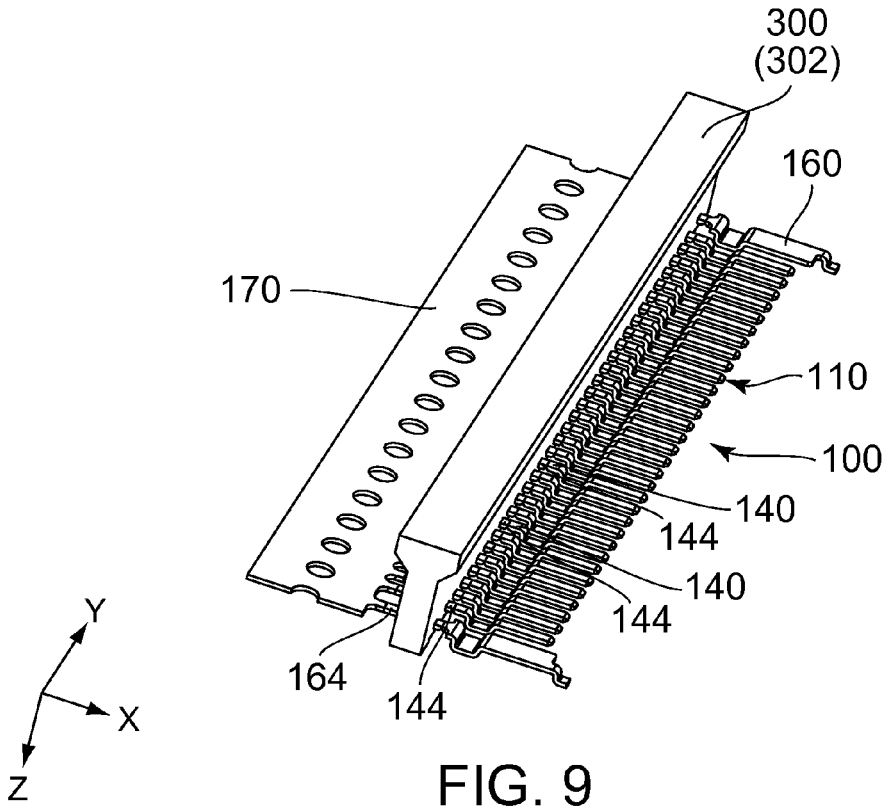
FIG. 9 is a perspective view showing the first connector of FIG. 8. The extending portions are coupled with each other by the carrier and by a temporary coupling portion.

As shown in FIG. 9, the temporary coupling portion 300 is formed via an insert-molding process. Accordingly, the extending portions 144 and the extending portions 164 are embedded in the temporary coupling portion 300 to be coupled with each other. Thus, the temporary coupling portion 300 couples the secondary portions 140 with each other through the extending portions 144. Next, when the carrier 170 is separated from the connector 100 by using the notches 172 and the notches 174, the connector 100 becomes in a state shown in FIG. 10.

Figure 10:
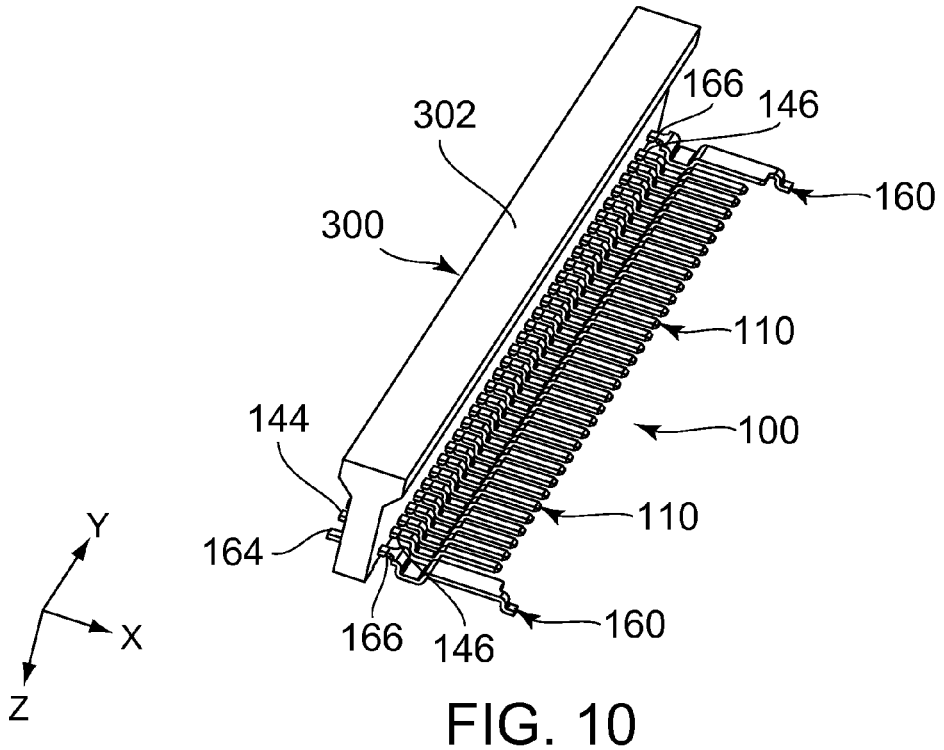
FIG. 10 is a perspective view showing the first connector of FIG. 9. The carrier is separated from the first connector while the extending portions are coupled with each other by the temporary coupling portion.

As shown in FIG. 10, before the first connector 100 is fixed on the first principal surface 510 (see FIG. 2), the temporary coupling portion 300 couples the first contacts 110 and the guide members 160 with each other. Although the first connector 100 comprises the first contacts 110 and the guide members 160 which are separable from each other, the temporary coupling portion 300 enables the first connector 100 to be easily handled. In addition, since the temporary coupling portion 300 has a relatively large planar portion 302, the temporary coupling portion 300 can be lifted up by picking the planar portion 302 up by the use of a vacuum chuck. Thus, the first connector 100 can be handled in an automatic component feeder system.

Figure 11:
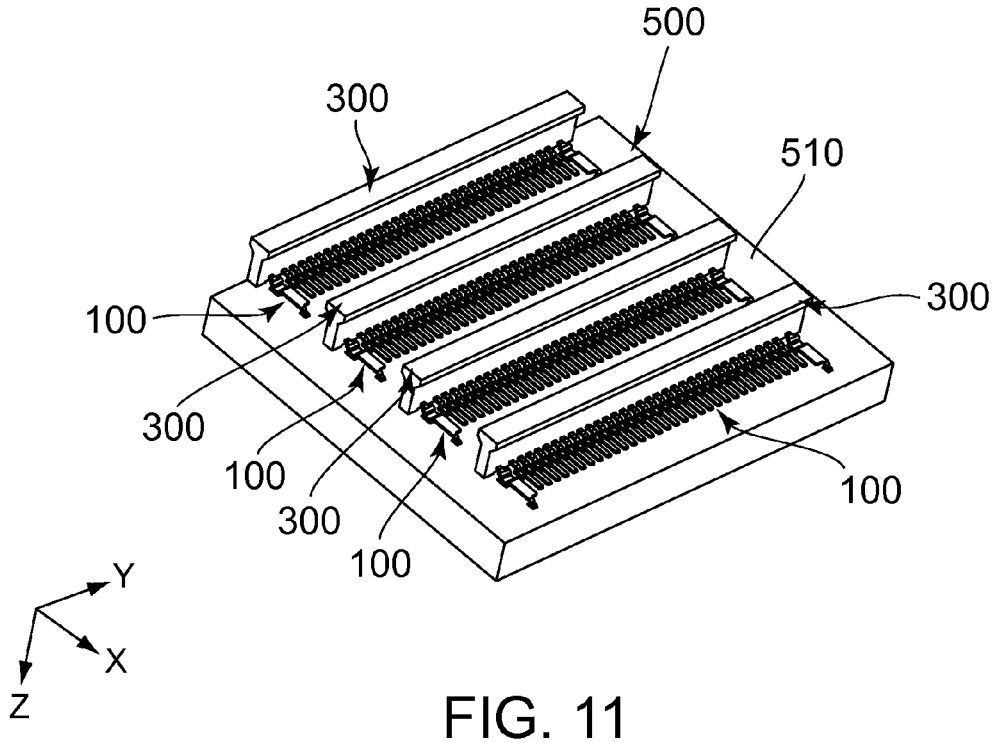
FIG. 11 is a perspective view showing a plurality of the first connectors of FIG. 10. The first connectors are fixed on the first connection object.

As shown in FIG. 11, each of the first connectors 100 comprises the first contacts 110 which are coupled with each other by the temporary coupling portion 300, and is fixed on a predetermined position of the first principal surface 510 of the first connection object 500. In this state, the first contacts 110 and the guide members 160 are soldered on the first principal surface 510. Furthermore, as understood form FIGS. 10 and 11, after the first contacts 110 and the guide members 160 are soldered on the first principal surface 510, the extending portions 144 and the extending portions 164 are separated from the first contacts 110 and the guide members 160 by using the notches 146, 166 together with the temporary coupling portion 300. Accordingly, the first contacts 110 and the guide members 160 are separated from each other as shown in FIG. 2. As described above, the first contacts 110 and the guide members 160 of the first connector 100 can be together fixed on the first principal surface 510 of the first connection object 500.

Figure 12:
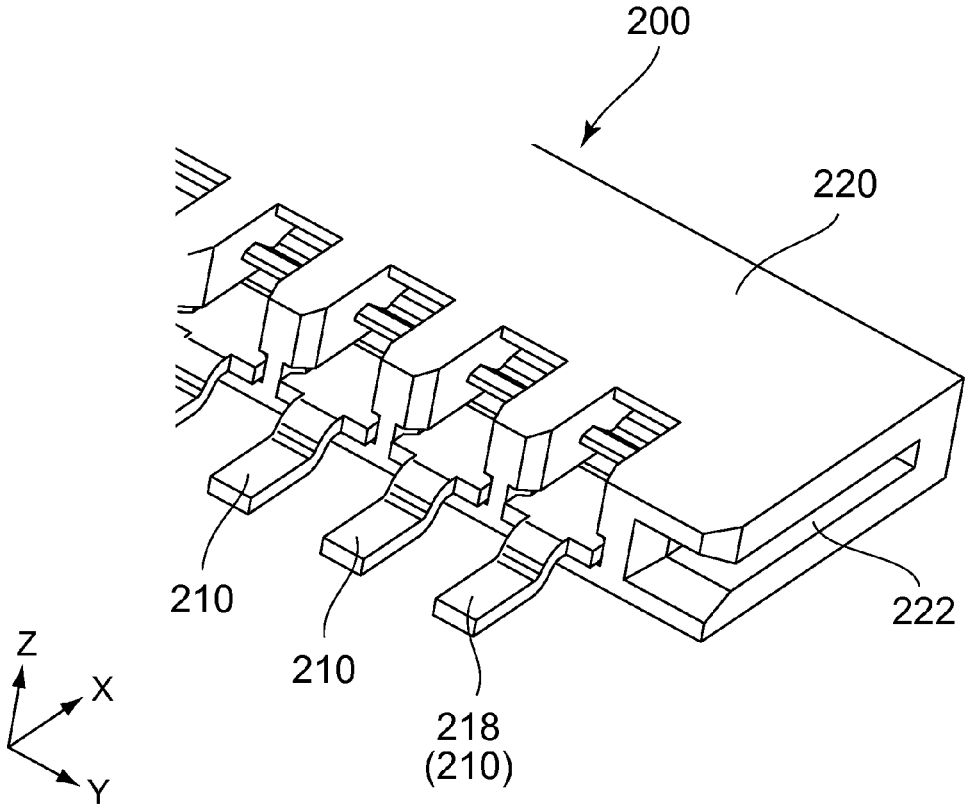
FIG. 12 is an enlarged, perspective view showing a part of the second connector of FIG. 1.

As shown in FIGS. 1 and 12, each of the second connectors 200 comprises a plurality of second contacts 210 and a holding member 220. The first contacts 110 correspond to the second contacts 210, respectively. The holding member 220 holds the second contacts 210 altogether. The holding member 220 of the present embodiment is made of resin having a thermal expansion coefficient similar to that of the second connection object 600. As understood from FIGS. 4 and 12, the holding member 220 is formed with guided portions 222 which are guided by guide portions 162 of the guide members 160, respectively.

Figure 13:
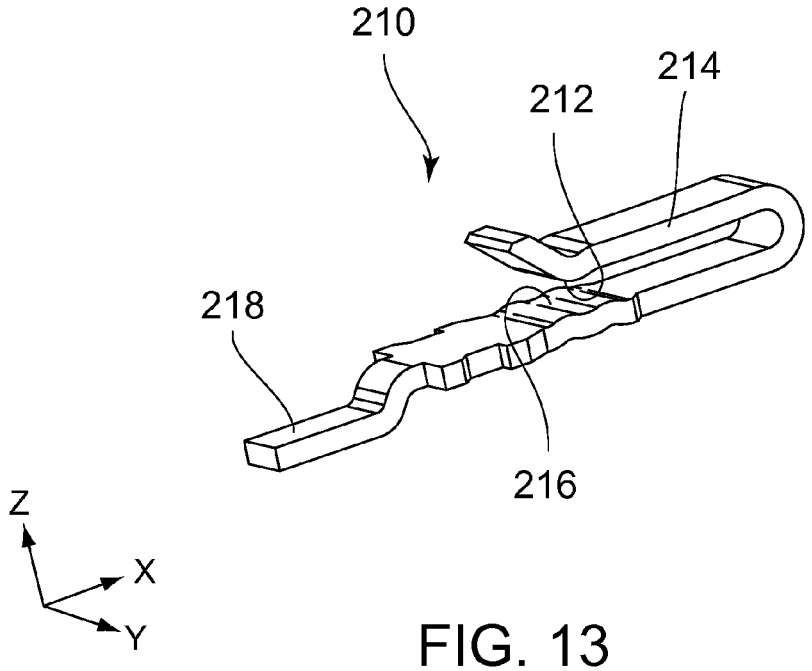
FIG. 13 is a perspective view showing a second contact which is included in the second connector of FIG. 12.

As shown in FIGS. 13 to 15, each of the second contacts 210 has a contact portion 212, a spring portion 214, a receiving portion 216 and a fixed portion 218. The contact portions 212 correspond to the receiving portions 216, respectively. The spring portion 214 resiliently supports the contact portion 212 so that the contact portion 212 is movable mainly in a Z-direction (perpendicular direction). The receiving portion 216 faces the contact portion 212 in the Z-direction. Although the receiving portion 216 of the present embodiment is formed as a part of the second contact 210, the present invention is not limited thereto. The receiving portion 216 may be formed separately from the second contact 210. For example, the receiving portions 216 may be formed as parts of the holding member 220, respectively. Each of the fixed portions 218 is soldered on the second principal surface 610 (see FIG. 3).

As understood from FIGS. 12 and 13, each of the second contacts 210 of the present embodiment is press-fitted into the holding member 220. However, the present invention is not limited thereto. The holding member 220 may holds the second contacts 210 by other means such as insert molding.

Connections of the first connectors 100 (see FIG. 2) fixed on the first principal surface 510 and the second connectors 200 (see FIG. 3) fixed on the second principal surface 610 are achieved as described below. As understood form FIGS. 2 and 3, the first principal surface 510 faces the second principal surface 610 in the Z-direction (i.e. a back surface 520 of the first connection object 500 faces in a positive Z-direction while the second principal surface 610 faces in the positive Z-direction), and the first connection object 500 is then moved in a first direction shown by an arrow 1 in FIG. 3, so that the first connection object 500 and the second connection object 600 are close to each other in the Z-direction. Meanwhile, two positive X-side corners of the first connection object 500 (see FIG. 3) are roughly positioned by two markers 620, respectively, which are formed on the second principal surface 610. Next, as shown in FIGS. 14 and 15, the first connection object 500 is moved in a second direction shown by an arrow 2 in FIG. 3, or in a positive X-direction, so that the first connectors 100 and the second connectors 200 are connected with each other. Meanwhile, the guide portions 162 guide the guided portions 222 (see FIG. 4), respectively, so that the first connectors 100 are appropriately moved in the positive X-direction.

As shown in FIG. 15, under a state where the first connector 100 and the second connector 200 are connected with each other, each of the contact portions 212 allows a movement of the pressed portion 132 in a plane (XY-plane) parallel to the first principal surface 510 (see FIG. 2) while pressing the pressed portion 132 against the receiving portion 216 in the Z-direction perpendicular to the first principal surface 510 (see FIG. 2) due to a resilient force of the spring portion 214. In other words, each of the pressed portions 132 is sandwiched between the contact portion 212 and the receiving portion 216. Thus, the first contacts 110 are connected with the second contacts 210, respectively.

Figure 4:
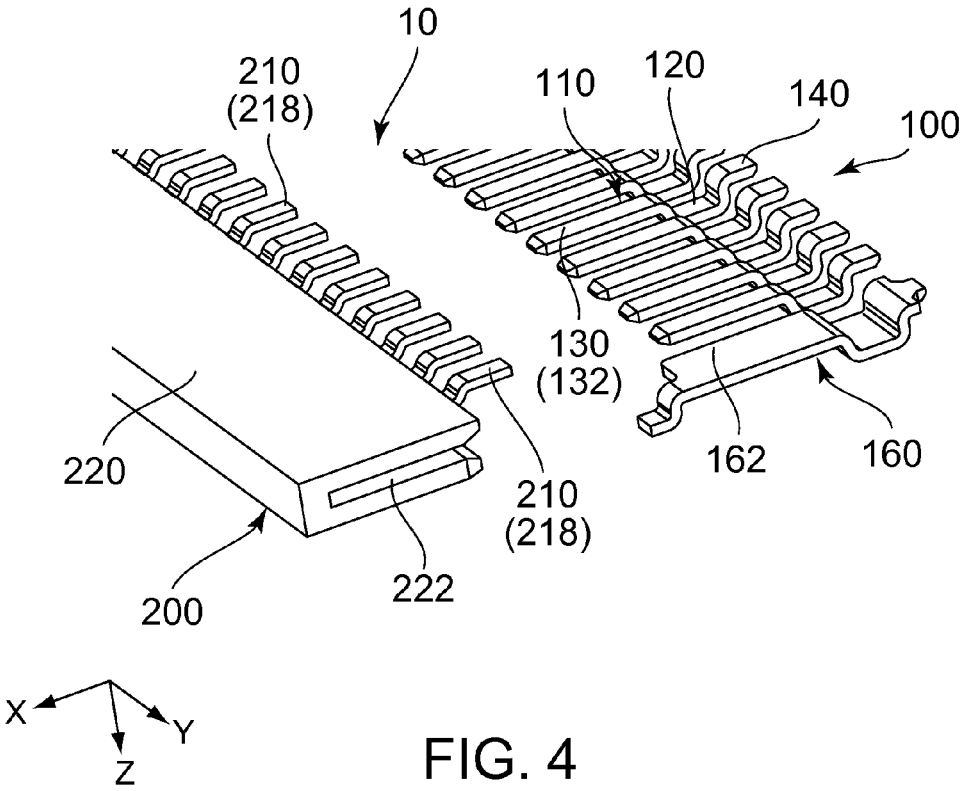
FIG. 4 is an enlarged, perspective view showing a part of the connector assembly of FIG. 1. The first connector is not connected with the second connector yet.
Figure 5:
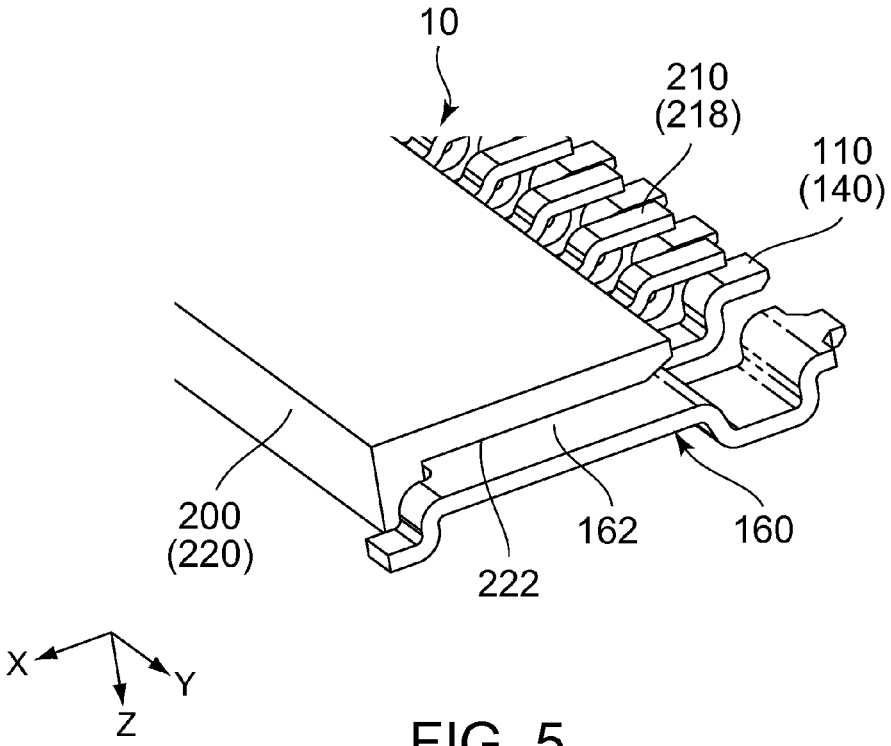
FIG. 5 is an enlarged, perspective view showing a part of the connector assembly of FIG. 1. The first connector is connected with the second connector.
Figure 6:
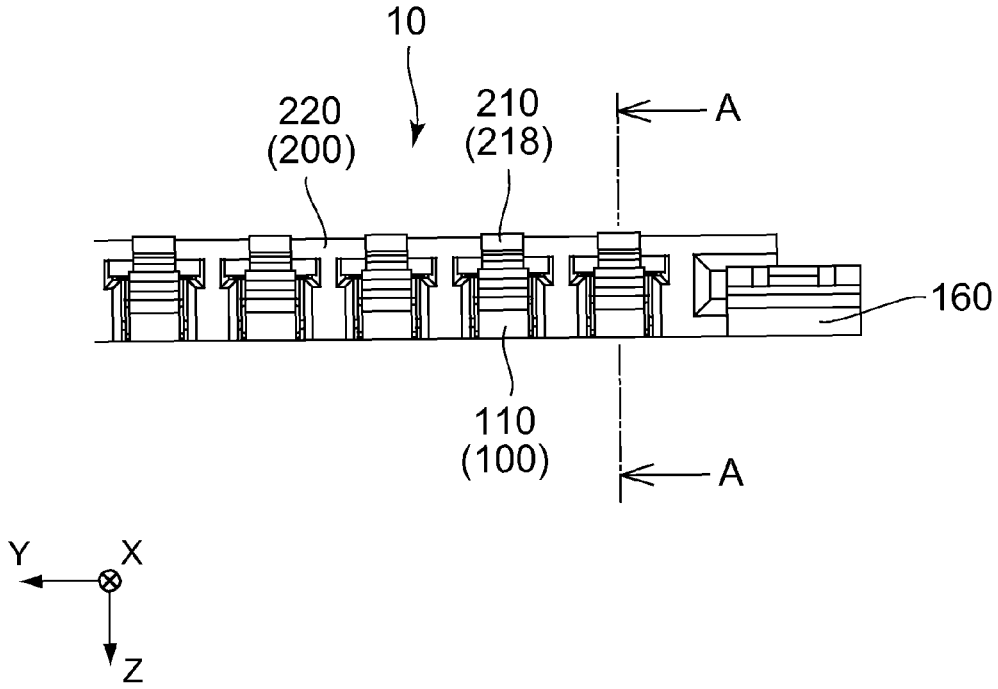
FIG. 6 is an enlarged, front view showing a part of the connector assembly of FIG. 1.

As understood from FIGS. 4, 14 and 15, each of the pressed portions 132 is sandwiched between the contact portion 212 and the receiving portion 216 so that each of the first contacts 110 is connected with the corresponding second contact 210. Accordingly, each of the pressed portions 132 maintains connection with the contact portion 212 while being movable to some extent between the contact portion 212 and the receiving portion 216 along the XY-plane. In a case where connection portions of the first contacts 110 and the second contacts 210 are unmovable in the XY-plane, stress concentrations occur at the soldered portions 120 by the thermal expansion or the thermal contraction of the first connection object 500 (see FIG. 2). According to the present embodiment, even if the first contacts 110 are moved by the thermal expansion and contraction of the first connection object 500, each of the first contacts 110 can maintains connection with the corresponding second contact 210. In addition, movements of the pressed portions 132 relieve stresses which are caused by the thermal expansion or the thermal contraction of the first connection object 500. Thus, unlike the connector assembly of Patent Document 1, the connector assembly 10 of the present embodiment does not have a local stress concentration nor a remaining stress.

While the present invention has been described with specific embodiments, the present invention is not limited to the aforementioned embodiments.

In the aforementioned embodiments, the temporary coupling portion 300 is wholly separated from the first connector 100. For example, a part of the temporary coupling portion 300 may however be remained on the first connector 100, provided that the first contacts 110 are separated from each other.

Figure 16:
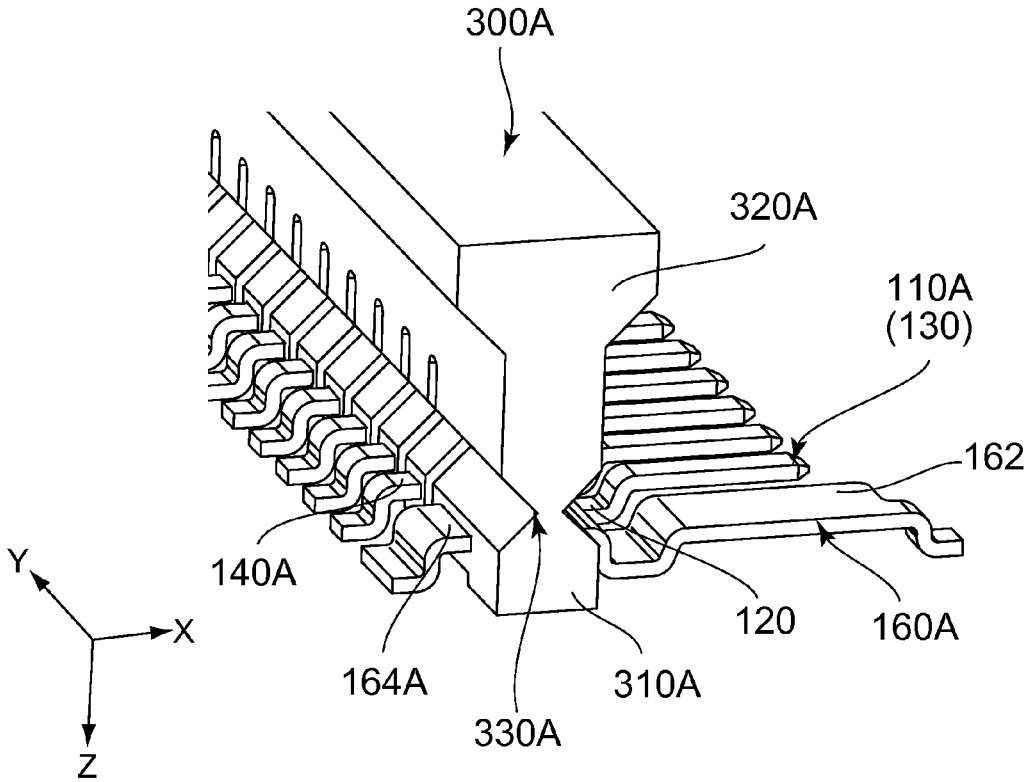
FIG. 16 is an enlarged, perspective view showing a part of a first connector according to a modification.
Figure 17:
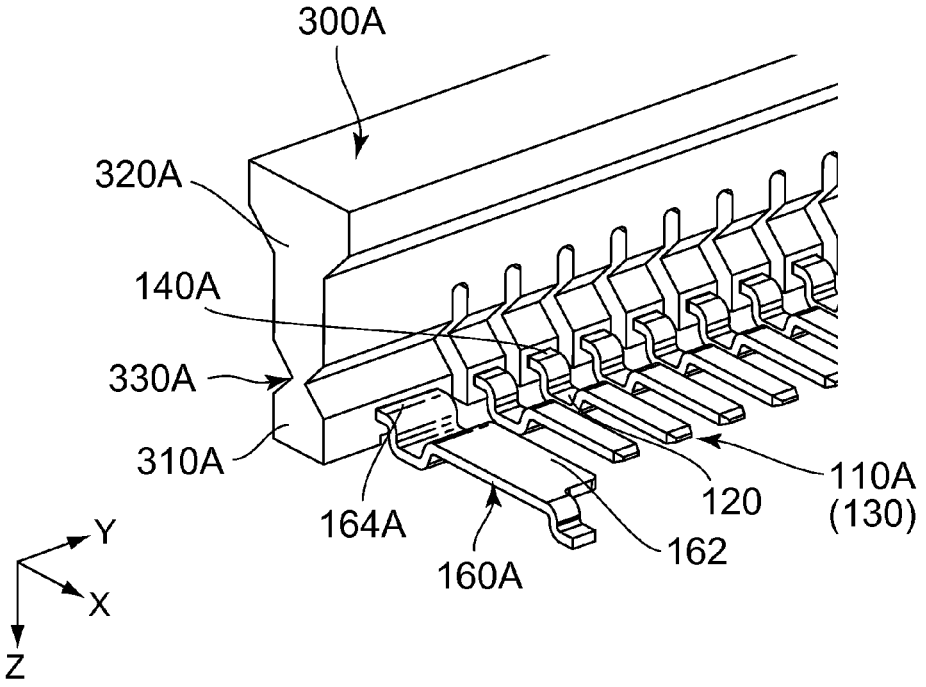
FIG. 17 is another enlarged, perspective view showing a part of the first connector of FIG. 16.
Figure 18:
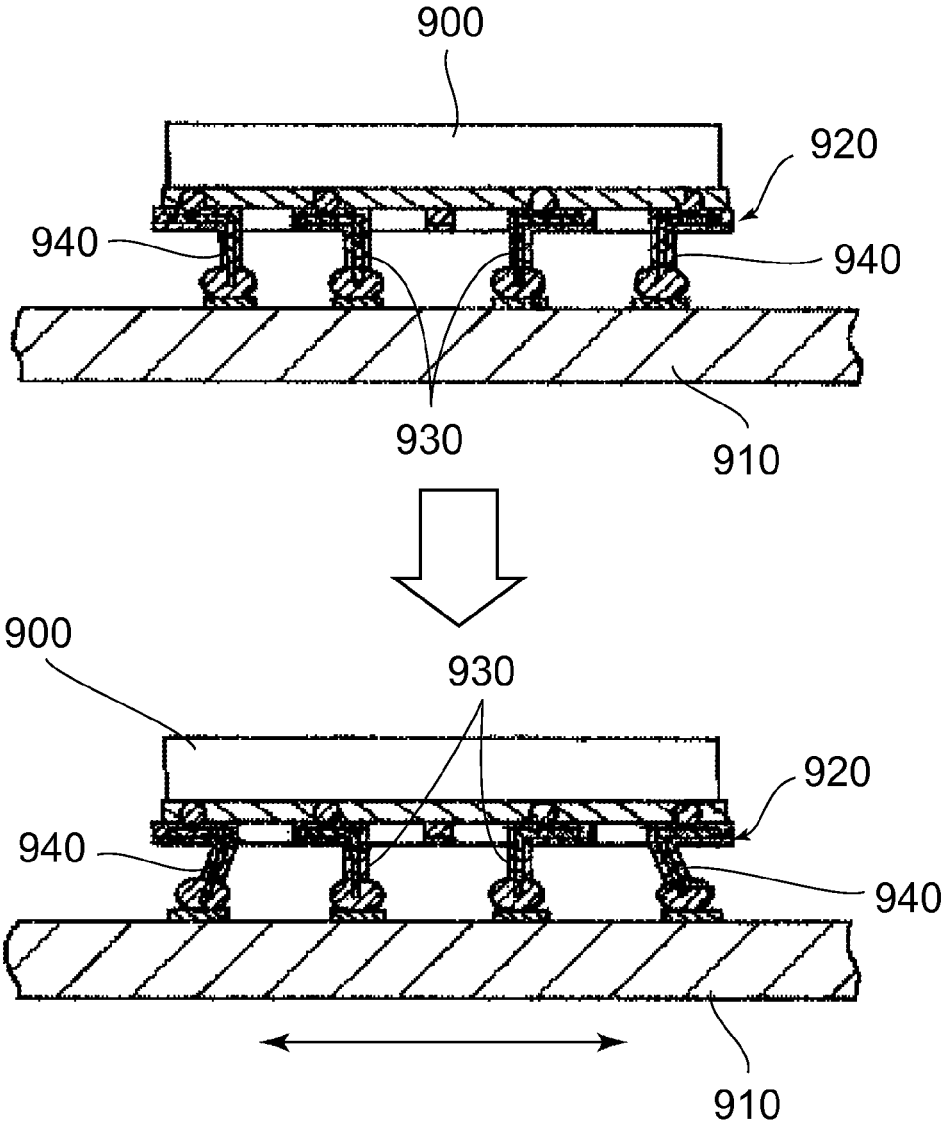
FIG. 18 PRIOR ART
FIG. 18 is a view showing a connector of Patent Document 1.

In detail, as shown in FIGS. 16 and 17, a temporary coupling portion 300A according to a modification includes a plurality of small portions 310A and a large portion 320A which couples the small portions 310A with each other. Two of the small portions 310A hold parts 164A of the guide members 160A, respectively. Remaining ones of the small portions 310A hold parts 140A of the first contacts 110A, respectively. At each of boundary portions between the small portions 310A and the large portion 320A, a notch 330A is formed.

The aforementioned structure enables the large portion 320A to be separated from the small portions 310A by using the notches 330A after the first contacts 110A and the guide members 160A are soldered on the first principal surface 510 (see FIG. 2). Accordingly, the first contacts 110A can be separated from each other.

The receiving portion 216 may be modified to be movable in the Z-direction. For example, the receiving portion 216 may be supported by a support portion having a spring-like property while a shape of the holding member 220 may be modified so as to allow a movement of the receiving portion 216 in the Z-direction.

In the aforementioned embodiment, each of the pressed portions 132 has an elongated, plate-like shape. Provided that the pressed portion 132 is allowed to be moved in the XY-plane under a state where the first contact 110 continues to be connected with the corresponding second contact 210, the pressed portion 132 may have a shape other than the shape. For example, the pressed portion 132 may have a round rod-like shape or a square rod-like shape.

In the aforementioned embodiment, each of the first contacts 110 has the pressed portion 132 and each of the second contacts 210 has the contact portion 212. Each of the second contacts 210 may have a pressed portion while each of the first contacts 110 may have a contact portion. In this case, the primary portion 130 is formed with a spring portion and the contact portion.

In the aforementioned embodiment, the temporary coupling portion 300 is made of insulator. The carrier may be used as a temporary coupling portion. Specifically, the temporary coupling portion may be made of metal.

The present application is based on a Japanese patent application of JP2014-107023 filed before the Japan Patent Office on May 23, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a first connector, and a second connector, wherein:

the first connector is adapted to be fixed on a first principal surface of a first connection object, the second connector is adapted to be fixed on a second principal surface of a second connection object, and the second connector is connectable with the first connector;

the first connection object and the second connection object are different in a thermal expansion coefficient from each other;

the first connector comprises a plurality of first contacts;

the plurality of first contacts are adapted to be separated from each other and soldered on the first principal surface;

the second connector comprises a plurality of second contacts;

the plurality of first contacts respectively correspond to the plurality of second contacts;

the plurality of second contacts are adapted to be soldered on the second principal surface;

one of: (i) the plurality of first contacts, and (ii) the plurality of second contacts, have a plurality of pressed portions;

the other of: (i) the plurality of first contacts, and (ii) the plurality of second contacts, have a plurality of contact portions and a plurality of spring portions;

the plurality of spring portions resiliently support the plurality of contact portions, respectively;

one of the first connector and the second connector comprises the other of: (i) the plurality of first contacts, and (ii) the plurality of second contacts;

the one of the first connector and the second connector further comprises a plurality of receiving portions;

the plurality of contact portions correspond to the plurality of receiving portions, respectively; and under a state where the first connector and the second connector are connected with each other, the plurality of contact portions allow movement of the plurality of pressed portions in a plane parallel to the first principal surface while pressing the plurality of pressed portions against the plurality of receiving portions in a perpendicular direction perpendicular to the first principal surface due to a resilient force of the plurality of spring portions.

2. The connector assembly as recited in claim 1, wherein:

the second connector comprises a holding member; and the holding member holds the plurality of second contacts altogether.

3. The connector assembly as recited in claim 1, wherein the plurality of receiving portions are respectively formed as parts of the other of: (i) the plurality of first contacts, and (ii) the plurality of second contacts.

4. The connector assembly as recited in claim 1, wherein:

the plurality of first contacts have the plurality of pressed portions; and the plurality of second contacts have the plurality of contact portions and the plurality of spring portions.

5. The connector assembly as recited in claim 1, wherein:

before the first connector is fixed on the first principal surface, the first connector further comprises a temporary coupling portion which couples the plurality of first contacts with each other; and after the plurality of first contacts are soldered on the first principal surface, the temporary coupling portion is, at least in part, separated from the first connector so that the plurality of first contacts are separated from each other.

6. The connector assembly as recited in claim 5, wherein the temporary coupling portion is made of an insulator.

7. The connector assembly as recited in claim 6, wherein:

the temporary coupling portion includes a plurality of small portions and a large portion;

the plurality of small portions hold the plurality of first contacts, respectively;

the large portion couples the plurality of small portions with each other; and after the plurality of first contacts are soldered on the first principal surface, the large portion is separated from the plurality of small portions so that the plurality of first contacts are separated from each other.

8. The connector assembly as recited in claim 7, wherein:

the temporary coupling portion further includes a plurality of boundary portions between the large portion and the plurality of small portions; and the plurality of boundary portions are formed with a plurality of notches, respectively.

9. The connector assembly as recited in claim 5, wherein:

before the first connector is fixed on the first principal surface, the first connector further comprises a plurality of extending portions, the plurality of extending portions extending from the plurality of first contacts, respectively, wherein each extending portion and a corresponding first contact are provided on a common member;

the temporary coupling portion couples the plurality of extending portions with each other; and after the plurality of first contacts are soldered on the first principal surface, the plurality of extending portions are separated from the plurality of first contacts together with the temporary coupling portion so that the plurality of first contacts are separated from each other.

10. The connector assembly as recited in claim 9, wherein:

the first connector includes a plurality of boundary portions between the plurality of extending portions and the plurality of first contacts, respectively; and the plurality of boundary portions are formed with a plurality of notches, respectively.

11. The connector assembly as recited in claim 5, wherein:

each of the plurality of first contacts includes a soldered portion, a primary portion and a secondary portion;

the plurality of soldered portions are to be soldered on the first principal surface;

the plurality of primary portions extend in one direction from the plurality of soldered portions;

the plurality of primary portions are formed with the plurality of pressed portions and the plurality of contact portions;

the plurality of secondary portions extend in another direction from the plurality of soldered portions; and the temporary coupling portion couples the plurality of secondary portions with each other.

12. The connector connectable with a mating connector which is adapted to be fixed on a second principal surface of a mating connection object, wherein the connector is adapted to be fixed on a first principal surface of a connection object, wherein:

the connector comprises a plurality of contacts;

the plurality of contacts are adapted to be separated from each other and soldered on the first principal surface of the connection object;

before the connector is fixed on the first principal surface of the connection object, the connector further comprises a temporary coupling portion which couples the plurality of contacts with each other;

after the plurality of contacts are soldered on the first principal surface of the connection object, the temporary coupling portion is, at least in part, separated from the connector so that the plurality of contacts are separated from each other;

each of the plurality of contacts includes a soldered portion, a primary portion and a secondary portion;

the plurality of soldered portions are to be soldered on the first principal surface;

the plurality of primary portions extend in one direction from the plurality of soldered portions;

the plurality of primary portions are formed with a plurality of pressed portions and a plurality of contact portions;

the plurality of secondary portions extend in another direction from the plurality of soldered portions; and the temporary coupling portion couples the plurality of secondary portions with each other.

13. The connector as recited in claim 12, wherein the temporary coupling portion is made of an insulator.

* * * * *